United States Patent [19]

Linne

[11] 4,087,898

[45] May 9, 1978

[54] METALLIC ROD PRODUCT, AND METHOD FOR PRODUCING SAME

[75] Inventor: Robert Steven Linne, Carrollton, Ga.

[73] Assignee: Southwire Company, Carrollton, Ga.

[21] Appl. No.: 749,570

[22] Filed: Dec. 10, 1976

Related U.S. Application Data

[60] Continuation-in-part of Ser. No. 598,976, Jul. 24, 1975, abandoned, which is a division of Ser. No. 543,058, Jan. 22, 1975, abandoned.

[51] Int. Cl.[2] ..... B21C 9/00

[52] U.S. Cl. ..... 29/527.5; 72/41; 72/187; 72/198; 72/274; 428/400

[58] Field of Search ..... 72/187, 198, 274, 278, 72/365, 366, 41; 29/193, 193.5, 527.7, 148.4 D; 428/397, 399, 400, 401

[56] References Cited

U.S. PATENT DOCUMENTS

| | | | |
|---|---|---|---|
| 1,940,573 | 12/1933 | Austin | 72/365 |
| 2,024,007 | 12/1935 | McColloch et al. | 29/148.4 D |
| 2,239,044 | 4/1941 | Leighton | 72/278 |
| 3,136,054 | 6/1964 | Palmer et al. | 72/187 |
| 3,956,915 | 5/1976 | Saunders | 72/198 |

*Primary Examiner*—Lowell A. Larson
*Attorney, Agent, or Firm*—Herbert M. Hanegan; Stanley L. Tate; Robert S. Linne

[57] ABSTRACT

Improved metallic rod product which substantially reduces die wear in wire drawing operations, and which provides other advantages during manufacturing. The exterior surface of the rod product is intentionally provided with a predetermined rough texture having certain characteristics, rather than the smooth bright surface conventionally imparted to metallic rod product intended for subsequent drawing into wire. Certain textured surface characteristics of the rod product reduce wear on the first few wire drawing dies by entraining lubricant as the rod moves through the dies, and carry the entrained lubricant into the dies, while at the same time avoiding some common wire drawing defects such as flakes and slivers. The textured-surface rod thus reduces frictional wear of the drawing dies, so that less force is required to draw the rod product through the dies and the useful life of the drawing dies is increased. The desired textured surface of the rod product is preferably provided by hot-rolling with finishing rolls having a roughened surface which is complementary to the desired surface roughness of the rod product; the useful life of such rolls is substantially greater than the life of rolls heretofore used to produce a smooth-finish rod, inasmuch as the textured surface rolls remain usable with a certain amount of wear. The use of complementary textured rolls provides certain texture characteristics not easily produced by any other means.

19 Claims, 4 Drawing Figures

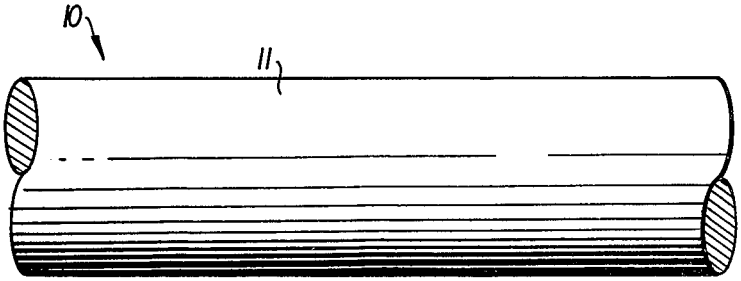
FIG. 1
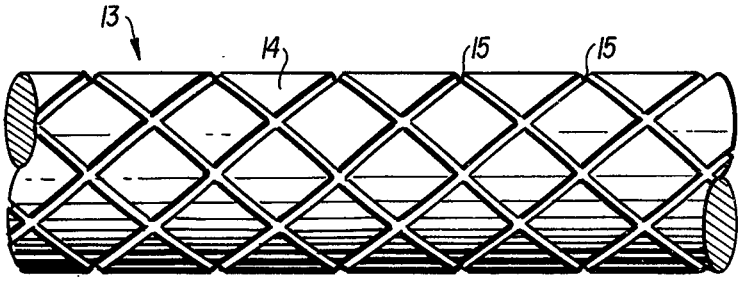
FIG. 2a
FIG. 2b
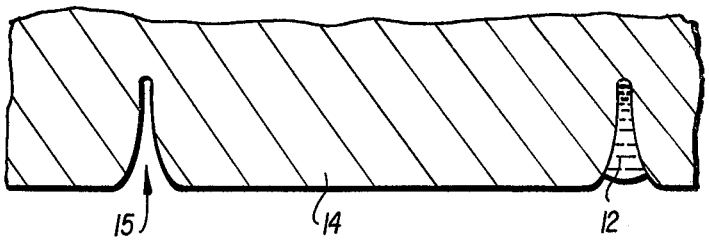
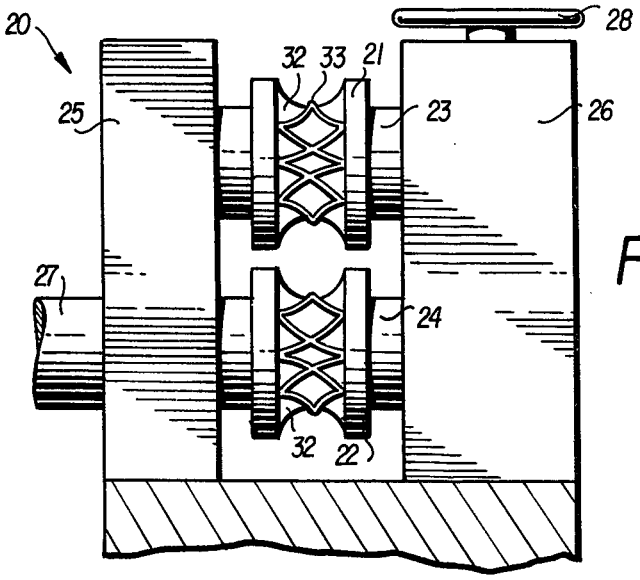
FIG. 3

METALLIC ROD PRODUCT, AND METHOD FOR PRODUCING SAME

CROSS-REFERENCE TO RELATED APPLICATIONS

This application is a continuation-in-part of co-pending application Ser. No. 598,976 filed July 24, 1975 now abandoned which in turn was a division of Ser. No. 543,058 filed Jan. 22, 1975, now abandoned.

BACKGROUND OF THE INVENTION

This invention relates in general to metallic rod products intended to be drawn into wire, and in particular to a metallic rod product having an intentionally textured surface and to the preparation of such product.

Metallic wire products are conventionally manufactured by a wire-drawing process in which a metallic rod product having a relatively large initial diameter is pulled through one or more wire-drawing dies, with the result that the rod is elongated and reduced in diameter to the desired diameter of the wire product. Drawn wire is typically produced in the foregoing manner from rod product which previously may have been manufactured in a continuous process including a continuous casting apparatus and a rolling mill for working and shaping the cast rod to a desired metallurgical state and physical configuration appropriate for subsequent wire-drawing utilization. Specific details of apparatus and processes for the manufacture of metallic rod products, such as copper rod and aluminum rod, are well known to those skilled in the art. Such processes are disclosed in U.S. Pat. Nos. 3,315,349; 3,561,105; 3,623,532; 3,500,811; and need not be repeated herein.

Those skilled in the art recognize that the act of drawing the rod through a wire-drawing die to elongate the rod causes the generation of very substantial frictional forces acting on the die and on the rod at the point of movement through the die. It is desirable to reduce this frictional wire-drawing die force as much as possible, inasmuch as the frictional force causes the expensive wire-drawing dies to wear, and consumes substantial amounts of power.

It has been considered in the prior art that rod products intended for use in wire drawing especially to make electrical conductor wires should have a very clean, smooth, shiny exterior surface, since it was believed that the smoothest practicable surface on the rod would best minimize friction when the rod was pulled through a wire-drawing die. The production of rod intended for wire drawing, accordingly, included manufacturing techniques necessary to produce rod having the very smooth surface heretofore considered essential for the reduction of friction in subsequent wire drawing. A smooth finish may be imparted to the rod product, for example, by passing the rod through one or more sets of rolling mill rolls which have very smooth, finely polished rolling surfaces to impart a smooth exterior surface to the rod product. It will be understood that the rolls used in rolling the rod product to a smooth shiny finish will undergo normal wear; such rolls routinely are replaced or reconditioned as soon as imperfections appear on the polished surface of the roll, since such imperfections would fail to produce the smooth polished surface heretofore considered necessary in a rod product intended for wire drawing operations.

In the event that the metallic rod is intended to be drawn into a small electrical conductor wire, it is often deemed desirable to shave the surface of the rod to remove any surface defect or contamination. This shaving produces an extremely slick and smooth surface which is known to increase the wear rate of the wire drawing dies.

One method considered, prior to the present invention, as a possible solution to some of the aforementioned problems was similar, in some basic respects, to a cleaning method disclosed by J. W. Leighton in U.S. Pat. No. 2,239,044. However this method, which involved shot-peening the rod to form shallow depressions on the surface, was rejected in favor of the present invention because of serious deficiencies in that method and additional unexpected benefits gained with the present invention.

The major deficiency with the prior method is that shot-peening the rod directly produces only shallow and rounded depressions in the surface. It is well known that in general the capillary forces acting to draw a liquid into a pit are much greater when the pit or depression is relatively narrow and sharp (i.e., where the walls of the pit form a sharp angle with the surface). It is also obvious that shallow depressions do not have sufficient volume to hold a large quantity of liquid.

Another deficiency to shot-peening is that it raises a ridge, however slight, around the edge of the depressions which are likely to cause a defect during subsequent drawing of the rod by either shearing off in the drawing die or becoming folded over by the die causing slivers on the wire. This drawback could possibly be avoided by a secondary smoothing operation, but subtracts from the simplicity of the method.

Still another deficiency is that shot-peening introduces stresses in the surface layers which reduces the ductility of the metallic rod and increases its strength. While the increased strength may be desirable, the reduced ductility increases the force necessary to deform the rod into wire.

A further deficiency is that there is a probability that some shot will become embedded into the surface, especially when peening ductile metal rods such as aluminum or copper. These embedded shot will cause a most serious defect if the rod is intended to be formed into electrical conductor wires.

Still another deficiency of shot-peening is that it is difficult to control the distribution or spacing of the depressions formed by shot-peening, especially when trying to peen a continuous metallic rod moving at speeds greater than 2000 feet per minute.

Related prior art processes are disclosed in U.S. Pat. Nos. 3,956,915, 2,078,434 and 3,136,054.

According to the present invention, it has been discovered that superior wire drawing and other benefits are obtained if the metallic rod product is intentionally provided with a certain textured surface, (i.e. striated) rather than with the smooth surface heretofore considered to be essential. The provision of striae on the exterior surface on the rod is believed to allow the rod, when used in a wire drawing operation, to pick up or entrain the drawing lubricant normally used in wire drawing, as the rod is pulled into and through the first few wire drawing dies. At least some of this entrained lubricant is carried into the dies along with the rod, thereby lowering the wear on the drawing dies and reducing the amount of force required to pull the rod through the dies. According to the present invention, the exterior surface of the rod product is roughened by providing certain specifically sized and shaped indentations or striations in the rod surface, more or less uniformly distributed along and about the surface. The intentionally textured surface of the rod product preferably should consist only of narrow, interrconnected depressions in the surface and should exclude high, free standing protrusions since protrusions on the surface of the rod product tends to be sheared off in the drawing dies, causing metal slivers and other defects in the wire.

Accordingly, it is an object of the present invention to provide an improved metallic rod product useful for forming into wire.

It is another object of the present invention to provide an improved process and apparatus for producing a metallic rod product useful for forming into wire.

It is still another object of the present invention to provide an improved process for forming wire by using a novel metallic rod product in combination with a wire drawing machine.

Other objects and many of the attendant advantages of the present invention will become more readily apparent from consideration of the following description of the disclosed embodiment, including the drawings in which:

FIG. 1 is a pictorial view showing an example of a metallic rod product of the prior art;

FIG. 2*a* shows a pictorial view of a metallic rod product according to the disclosed embodiment of the present invention;

FIG. 2*b* shows a magnified view of a section near the surface of rod 2*a;* and FIG. 3 shows an end-on elevation view of roll apparatus useful in the preparation of rod product according to the present invention.

The present invention as shown in the disclosed embodiment is better understood with reference to a typical metallic rod product of the prior art as shown generally at 10 in FIG. 1. The rod 10 has an exterior surface 11 which is substantially devoid of any protrusions, depressions, or other kinds of surface irregularities other than occasional defects. The exterior surface 11 of prior art rod is typically smooth and slick, having been rolled in a rolling mill including at least one roll stand or rolling stage having smooth-surfaced rolls. The relatively smooth exterior surface 11 of prior-art rod product, as discussed above, was believed to be necessary for minimizing frictional forces within a wire-drawing die, when the rod product was used in a subsequent wire drawing process.

Turning now to FIG. 2, there is seen an example 13 of rod product according to a disclosed embodiment of the present invention. It is seen from FIG. 2 that the exterior surface 14 of the rod product 13 has a network of minute, substantially interconnected grooves (striations) with the striae being the result of numerous channels 15 which are formed into the nominal circumference 16 of the rod product. Although the channels 15 are depicted in FIG. 2 as being in the shape of grooves and having substantially a linear configuration, the particular configuration of the depressions 15 is not considered to be a limiting feature of the improved rod product. The size of the channels 15 is exaggerated in FIG. 2*a*, for better understanding of the disclosed embodiment, and even further exaggerated in FIG. 2*b* which shows a cross section of the rod 13 at higher magnification wherein a droplet 12 of lubricating fluid is shown entrained in depression 15.

It is desirable that the roughened exterior surface 14 is provided only by the minute channels 15, of whatever configuration, rather than by a raised or protuberant pattern which protrudes or otherwise extends radially beyond the nominal circumference 16 of the rod product. A raised pattern tends to be sheared off in the drawing dies, causing slivers and other defects to appear in the wire drawn through the dies.

This fact was discovered during preliminary testing where textured rod was produced by using finished mill rolls which were knurled so as to form striations in the rolling surface. However, these striations in the rolls produced a complementary raised pattern on the rod. This particular texture did give some benefits during manufacture of the rod, such as improved cleaning, coating, and coiling of the rod and increased life of the rolls. However during subsequent wire drawing tests a serious deficiency was noted. The raised pattern on the rod was partially sheared off in the wire drawing dies causing an accumulation of metallic slivers in the machine and producing defects on the wire itself. Also the raised pattern on the rod evidently did not entrain enough extra lubricant on the rod surface to substantially reduce the wear of the drawing dies. The rod product is serially drawn through a number of dies during a typical wire drawing operation, and the repetitive passage of the present rod product through the several dies smoothes out the roughened rod surface to substantially eliminate surface texture in the resulting wire product.

There is a range of exterior surface roughness which gives preferable beneficial results according to the present invention, with the upper and lower limits of the range being dependent on the particular metal of the rod product and type of lubrication used in wire drawing. The channels 15 or other roughness of the exterior surface 14 must be sufficient to entrain at least some lubricant for lubricating the wire-drawing die, in order that the beneficial effects of reduced drawing friction can be obtained. If the exterior surface 14 of the improved rod product 13 is slightly too rough and bumpy, no lubrication will be entrained in the channels and if the surface is grossly rough there will be unusual forces created in the wire-drawing die as the rod is being drawn through the dies, and these forces may cause the wire to break. The maximum surface roughness is best determined by experimentation for any particular metal or metal alloy. In general, the optimum surface texture depends on the exact composition of the metallic rod and the type of lubricants used in the subsequent wire drawing operations since it is the relative surface energies of each which determine the forces between a solid and a liquid. It is known that the work of adhesion between a liquid and a solid (i.e., the free energy change when liquid and solid are joined) is:

$$W = SS + SL/V - SS/L$$

where $SS$ = Surface free energy of liquid in equilibrium with its vapor, and $SS/L$ = surface free energy of the solid/liquid interface.

These values are difficult to calculate in advance but they may be found by experimentation. Once these values are obtained, they may be used to predict the shape or other characteristics of a fluid film on a textured metallic suface which in turn can lead to a determination of an optimum texture necessary to achieve any particular desired lubricating film shape. Of course, there are other characteristics which must be considered depending on the particular manner in which the textured metallic rod is formed into wire.

For example, the channels, or other depressions of the texture surface, should be small enough so that they will be filled by the lubricating fluid, due to capillary action, but large enough so that the rate of filling is not a limit on the process speed.

It is known that the distance D, to which a liquid is drawn between two parallel walls separated by a width W is: $D = 2\ (SS-SS/L)/pw$ where SS and SS/L are the surface energies defined above and $p$ is the density of the liquid.

Also the velocity V of flow of a liquid into the space between two parallel walls with a separation of W is: $V=W^2DP/8UH$ where U is the viscosity of the liquid, and H is the distance to which the liquid has already penetrated.

It may be deduced that other things being equal, the depth to which a liquid fills a capillary space increases, and the rate of flow into the space decreases, as the separation of the surfaces is reduced.

By way of one specific example, a hot-formed continuously-cast copper-base rod product of the type described in U.S. Pat. No. 3,315,349 is effectively treated according to the present invention when the exterior surface of the rod product has a surface roughness on the order of about 1,000 micro-inches, RMS. Values of minimum, maximum, and optimum surface roughness for various metallic rod products will be readily determinable by those skilled in the art without undue experimentation since there is a rather wide range in which some benefits are obtained. It is preferred that the surface roughness be at least 20 micro-inches, R.M.S., and that the individual depressions or channels be about 0.01 to 1.00 mils deep. The spacing between depressions or channels is found by considering the above values but a preferred spacing is such that the rod product will have at least ten depressions or channels in a length equal to the diameter of the rod. This insures that small diameter rods have a finer texture than larger sized rods. Best results according to the present technique have been obtained when the depressions 15 in the exterior surface 14 present an even roughness which is devoid of sharp edges or other discontinuities which tend to cause flaking or slivering when the roughened rod product is drawn into wire.

Although the roughened rod product as described herein can possibly be made by other appropriate technique or apparatus, one preferred example of apparatus for producing the improved rod product is shown in FIG. 3 and includes the roll stand indicated generally at 20. The roll stand 20 includes an upper roll 21 and a lower roll 22 which are connected to respective shafts 23 and 24 extending between the left upright 25 and the right upright 26. The shaft 24 extends outwardly as at 27 beyond the left upright 25, and it will be understood by those skilled in the art that the shaft extension 27 is connected to a suitable motor (not shown) or other source of motive power. Those skilled in the art will also understand that the shafts 23 and 24 are rotationally interconnected by gears or other suitable drive means mounted within one or both of the uprights 25 and 26, so that the two shafts and the rolls 21 and 22 rotate in the opposite rotational direction from each other when the shaft extension 27 is rotated by a source of motive power. Those skilled in the art will also appreciate that the spacing between the upper roll 21 and the lower roll 22 is adjustable by manipulation of the wheel 28 extending from the right upright 26. The entire roll stand 20 may comprise the last roll stand of a multiple-stand rolling mill of the type which is positioned and employed to receive and roll continuously-cast metallic rod produced by a continuous casting machine of the type known to those skilled in the art.

The aforementioned U.S. Pat. No. 3,315,349, which is assigned to the assignee of this invention, is exemplary of systems for continuously producing elongate metal rod by continuously casting molten metal into cast bar and then substantially immediately hot-forming the cast bar into continuous rod in a rolling mill having a plurality of roll stands disposed therein.

Whereas the last roll stand commonly associated with rod rolling mills of the prior art has rolls with a smooth polished rod rolling surface, each of the rolls 21 and 22 is provided with an evenly-roughened surface 32 which may be complimentary to the desired surface roughness of the exterior surface 14 on the rod product 13, as discussed hereinabove. It will be appreciated that the roughened surface 32 of each roll 21 and 22 comprises protrusions 33 (depicted in exaggerated size in FIG. 3) extending radially outwardly from the nominal peripheral circumference of the roll, since the protrusions are necessary to provide the corresponding depressions 15 on the exterior surface 14 of a rod product to be treated by hot rolling in the roll stand 20. The roughened rolling surfaces of the rolls 21 and 22 should not have any large, deep surface depressions or indentations (as might be found on old worn and pitted rolls, for example) inasmuch as such surface depressions tend to produce a localized raised pattern on the exterior surface 14 of the rod product, with the attendant undesirable results discussed above. Also the percent reduction of the bar as it is rolled through these rolls should be relatively light, about 10 to 15% was found to be preferred when forming a textured copper rod. This limit on the reduction is to avoid excessive amounts of slip, often associated with heavy reductions, which could smear the desired surface texture.

Rolls having the desired surface roughness characteristics have been manufactured by shot peening an unhardened smooth-surface tool steel mill roll to the desired even roughness then heat treating to provide a hard, long lasting textured mill roll. Considering the specific example given hereinabove, the rolls would be shotpeened to about 1,000 micro inch RMS surface finish.

By shot-peening the unhardened rolls, ridges are raised around each point of impact. These ridges then form complimentary channels in the rod surface during rolling. This is the preferred method of forming textured rod because it has unexpected additional benefits. The useful life of such roughened rolling mill rolls is increased relative to the life of smooth surfaced rolls, used previously to provide a smooth-surface rod product, because relatively minor imperfections can be tolerated in the already roughened surface before reconditioning of the roll surface is preferred.

It is important that the rolling surface of the mill rolls be completely and uniformly shot-peened so that many interconnecting ridges are formed which then will form interconnecting channels on the rolled rod.

Another suitable method to produce rolling mill rolls having the desired even roughness is to selectively electroplate a hard metal, such as chromium, onto the rolling surfaces to form a network of raised ridges such as shown exaggerated in FIG. 3.

It should be understood that either method should form a very fine network of interconnecting ridges which protrude from the rolling surface for a distance which is preferably greater than their width so that the channels formed in the rolled rod product are about as deep as they are wide.

Since it is preferred that the roughened rod product described herein be devoid of surface protrusions, it may be necessary to provide a rod smoothing roll stand or other surface smoothing means to provide the desired surface smoothness of the rod product before or after the rod product passes through the roll stand 20.

An important operational advantage resulting from rod product having a roughened exterior surface as described herein is the aforementioned reduction in friction when the rod is drawn into wire. Tests conducted with drawing wire from rod product having a roughened surface according to the present invention indicate that the wear of wire-drawing dies, when reducing the diameter of the rod about 25 to 35%, is reduced in the order of about 20 to 25%, when compared to the wear life of similar dies used to draw smooth-surface rod product. An even greater increase in die life would be experienced when compared to dies used in drawing shaved rod, which has an extra smooth surface, when forming certain electrical conductor wires.

Although the aforementioned improvement in die life and decrease in rod pulling force which are obtained by reducing wire-drawing die friction is a significant advantage of the present invention, several other advantages are apparent with rod product as described herein. Rod product is frequently continuously surface-cleaned and cooled by passing the rod through a liquid cleaning and cooling agent, for example, and rod having a roughened surface as described herein is more readily cleaned and cooled because of the increased surface area of the roughened-surface rod and also because of the increased turbulence created in the cleaning and cooling solution, by movement of the roughened surface therethrough, which increases heat transfer rates.

The surface roughness of rod product according to the present invention also permits the better application of a rod protective coating during rod production. After the rod product is cleaned and before being coiled by a conventional rod coiling machine, the rod product frequently is provided with a sprayed-on or dipped wax type coating to protect the rod product during shipment. The roughened surface according to the present invention allows application of a more adherent and uniform coating which improves the shelf life of the rod product.

The aforementioned rough surface of rod product according to the present invention provides the added advantage of improved coilability of the rod. A smooth surfaced rod tends to be so slick that attempts to coil the rod product in the conventional coiling machine frequently cause the coils of rod to fall over one another, so that the rod is awkward to ship and may become entangled. The present rod product having a roughened surface, however, is less likely to shift while being coiled and/or moved about.

For the purpose of clarity, the following terminology used in this application is explained as follows:

cast bar —a solid product substantially as cast for forming into rod.

rod—a solid product that is long in relation to its cross-sectional diameter. Rod commonly has a cross-sectional diameter of between $\frac{5}{8}$ inch and $\frac{1}{8}$ inch.

wire—a solid wrought product that is long in relation to its cross-section which may be round or rectangular and whose diameter is between 0.125 in. and 0.01 in.

Striae—a minute groove or channel.

R.M.S.—Root-Mean-Square, an averaging value useful for expressing surface roughness meansurements.

It will be apparent that the foregoing relates only to a disclosed embodiment of the present invention, and that numerous alterations and modifications can be made therein without departing from the spirit and the scope of the invention as described in the following claims.

I claim:

1. A method of providing an improved metallic rod product for subsequent forming into wire, comprising the steps of:

(a) continuously casting molten metal into a cast bar, (b) substantially immediately hot-forming the cast bar into rod, and (c) forming minute channels, of at least 20 micro-inches roughness substantially uniformly about the circumference of the rod while in the hot-forming range, and (d) cooling the rod.

2. The method of claim 1 wherein the step of cooling the textured rod comprises moving said rod through a cooling fluid at a velocity sufficient to cause turbulant fluid flow about said rod thereby providing an increase in the cooling rate of said rod as compared to the cooling rate provided by laminar fluid flow about a smooth surfaced rod.

3. The method of claim 2 wherein the rod product is electrical grade copper and the minute channels are at least sufficient to give a surface roughness measurement of 1000 microinches.

4. The method of claim 1 wherein the step of forming minute channels is accomplished by deforming said rod in a hotrolling mill, by roll means having a rod rolling surface which is covered with a network of substantially interconnected ridges.

5. The method of claim 4 wherein said network of ridges are formed by shot-peening the rod rolling surface of an unhardened metallic roll, then hardening said roll, to provide a surface roughness measurement of between about 20 and about 1,000 micro-inches.

6. In the production of metallic rod for subsequent forming into wire, a continuous-rod method for improving lubricant adhesion to the surface of said rod during subsequent wire drawing operations, comprising the steps of:

providing cast metallic bar at a hot-forming temperature, processing said cast bar to rod by hot rolling in a continuous-rod rolling mill means including performing final reducing operations to impart a selected surface texture to said rod, said final reducing operations including the steps of providing roll stand means with surface contact rolls of preselected embossed finishes, and passing the continuous rod through said roll stand means to reduce its size by up to 15% and impart a complementary pattern of surface indentations on said rod surfaces, said surface indentations including minute channels providing a textured surface for entraining lubricant fluids on that surface of the continuous rod to be subsequently exposed to wire drawing dies.

7. The method of claim 6 wherein said roll stand means comprise a plurality of consecutive roll stands and the preselected finish is on the surface contact rolls in at least the last of such stands and is about 1000 microinches in roughness.

8. The method of claim 6 wherein said preselected finish is characterized by having a surface roughness measurement of between about 20 and about 1,000 micro-inches.

9. An improved method of drawing an elongate rod product into wire, said rod product having been produced by continuously casting molten metal into a cast bar and then substantially immediately hot-forming the bar into continuous rod wherein the improvement comprises the steps of:

(a) forming minute channels substantially uniformly about and along the circumference of the rod product while in the hot-forming temperature range to provide a rough textured surface;

(b) exposing the rough textured surface of said rod product to a lubricating fluid which is received within said channels; and then (c) drawing the rod product through a die to form wire.

10. The method of claim 9 wherein the die of step (c) reduces the diameter of the rod by at least 10 percent.

11. The method of claim 10 wherein said rough textured surface is characterized by having a surface roughness which measures between about 20 and 1,000 micro-inches.

12. The method of claim 9, wherein said rod product is hot-formed in a rolling mill having a plurality of consecutive roll stands disposed therein, and wherein said step of forming channels is performed in at least the last of said roll stands.

13. The method of claim 12 wherein said step of forming channels is accomplished by providing a roughened surface on the rolling surfaces of the roll stands, said roughened surfaces formed by shot-peening the rolling surfaces to about 1000 microinch, R.M.S., surface finish.

14. An improved metallic rod product for forming into wire of the type having an elongate peripheral surface substantially devoid of protrusions, wherein the improvement comprises means for entraining fluid hot-formed in the exterior surface of said rod product, said means for entraining fluid is a number of minute channels hot-formed on the exterior surface of said rod product and said minute channels are substantially interconnected and are dispersed substantially uniformly about and along the exterior surface of the rod.

15. The rod product of claim 14 wherein said channels are at least sufficient to entrain and carry a lubricating fluid through the first of a series of wire drawing dies, and said channels are insufficient to form defects on the finished wire.

16. The rod product of claim 15 further characterized by having a surface roughness which measures between about 20 and 1,000 micro-inches.

17. The rod product of claim 15 wherein said channels are spaced along the axis of the rod such that within a length numerically equal to the diameter of the rod, there are at least ten of said channels.

18. The rod product of claim 17 wherein said channels are at least about 0.001 inches wide and less than about 0.100 inches wide and are at least as deep as they are wide.

19. The rod product of claim 17 wherein the rod product is electrical grade copper and the minute channels are at least sufficient to give a surface roughness measurement of 1000 microinches.

* * * * *